US011980997B2

(12) United States Patent
Mitsui et al.

(10) Patent No.: US 11,980,997 B2
(45) Date of Patent: May 14, 2024

(54) DRESSING APPARATUS AND POLISHING APPARATUS

(71) Applicant: OKAMOTO MACHINE TOOL WORKS, LTD., Gunma (JP)

(72) Inventors: Takahiko Mitsui, Gunma (JP); Eiichi Yamamoto, Gunma (JP)

(73) Assignee: OKAMOTO MACHINE TOOL WORKS, LTD., Gunma (JP)

( * ) Notice: Subject to any disclaimer, the term of this patent is extended or adjusted under 35 U.S.C. 154(b) by 56 days.

(21) Appl. No.: 17/371,909

(22) Filed: Jul. 9, 2021

(65) Prior Publication Data

US 2022/0016742 A1 Jan. 20, 2022

(30) Foreign Application Priority Data

Jul. 16, 2020 (JP) ..... 2020-121966

(51) Int. Cl.
*B24B 53/017* (2012.01)
*B24B 37/20* (2012.01)

(52) U.S. Cl.
CPC ..... *B24B 53/017* (2013.01); *B24B 37/20* (2013.01)

(58) Field of Classification Search
CPC ..... B24B 37/245; B24B 37/14; B24B 37/30; B24B 53/017; B24B 53/003; B24B 53/005; B24B 53/02; B24B 53/095; B24B 53/12; B24B 55/02; B24B 57/02; B24B 53/042; B24B 53/345; B24B 53/30; B24B 53/34; B24B 41/005
USPC ..... 451/56, 443, 444, 453
See application file for complete search history.

(56) References Cited

U.S. PATENT DOCUMENTS 6,086,457 A * 7/2000 Perlov ..... H01L 21/67051 451/287
6,341,997 B1 * 1/2002 Lin ..... B08B 5/02 451/39
6,402,598 B1 * 6/2002 Ahn ..... H01L 21/67051 451/41

(Continued)

FOREIGN PATENT DOCUMENTS

JP 2001-30169 A 2/2001
JP 2002-187059 A 7/2002

(Continued)

OTHER PUBLICATIONS

Machine translation of KR-20060114994-A (Year: 2006).*
Wikipedia nickel electroplating, 2016 (Year: 2016).*

*Primary Examiner* — Joel D Crandall
*Assistant Examiner* — Robert F Neibaur
(74) *Attorney, Agent, or Firm* — RANKIN, HILL & CLARK LLP

(57) ABSTRACT

A dressing apparatus includes a dresser provided in a polishing apparatus for polishing a board-like work by relative movement between the work and a polishing pad while bringing the polishing pad into contact with the work, the dresser having a dressing surface that slides relative to a polishing surface of the polishing pad to dress the polishing pad; a dresser drive member that rotates the dresser; a high-pressure water generating device that supplies high-pressure water pressurized to 1 to 15 MPa; and a high-pressure water injection nozzle that injects the high-pressure water toward the dressing surface rotating.

9 Claims, 3 Drawing Sheets

(56) References Cited

U.S. PATENT DOCUMENTS

| | | | | |
|---|---|---|---|---|
| 6,443,815 | B1 * | 9/2002 | Williams | B24B 53/017 451/60 |
| 6,609,962 | B1 | 8/2003 | Wakabayashi et al. | |
| 6,634,934 | B1 * | 10/2003 | Akaike | B24B 53/017 451/287 |
| 6,695,684 | B2 * | 2/2004 | Park | B24B 53/017 451/60 |
| 6,780,088 | B1 * | 8/2004 | Nishihara | B24B 53/017 451/36 |
| 6,939,208 | B2 * | 9/2005 | Kamimura | B24B 29/005 451/72 |
| 9,700,988 | B2 * | 7/2017 | Yamaguchi | B08B 1/04 |
| 11,383,351 | B2 * | 7/2022 | Takenouchi | B24B 7/241 |
| 11,446,711 | B2 * | 9/2022 | Wu | H01L 21/67051 |
| 11,633,833 | B2 * | 4/2023 | Wu | B24B 53/005 451/56 |
| 2006/0121837 | A1 * | 6/2006 | Seike | B24B 53/017 451/56 |
| 2022/0168866 | A1 * | 6/2022 | Baba | B01J 35/004 |

FOREIGN PATENT DOCUMENTS

| | | | | |
|---|---|---|---|---|
| JP | 2005-271101 | A | 10/2005 | |
| KR | 20060114994 | A * | 11/2006 | B24B 53/017 |

* cited by examiner

DRESSING APPARATUS AND POLISHING APPARATUS

CROSS-REFERENCE TO RELATED APPLICATION

This application claims priority from Japanese Patent Application No. 2020-121966 filed with the Japan Patent Office on Jul. 16, 2020, the entire content of which is hereby incorporated by reference.

BACKGROUND ART

1. Technical Field

One aspect of the present disclosure relates to a dressing apparatus and a polishing apparatus including the dressing apparatus.

2. Related Art

Conventionally, the dressing apparatus has been used in the polishing apparatus for polishing a surface of a semiconductor wafer or the like. The dressing apparatus dresses a surface of a polishing pad in order to stably maintain polishing characteristics of the polishing pad. This type of dressing apparatus uses diamonds, nylon brushes, or high-pressure water to remove clogging of the polishing pad and sharpen the polishing pad.

For example, JP-A-2005-271101 discloses the dressing apparatus for dressing a polishing pad used for chemical mechanical polishing (CMP). The dressing apparatus disclosed in JP-A-2005-271101 includes a dressing plate having a surface on which diamond abrasive grains are electrodeposited, and a brush plate disposed on an inner peripheral side of the dressing plate and having a surface on which a brush is planted.

A through-hole is drilled in a central portion of the brush plate. A cleaning liquid supply pipe is inserted inside the through-hole. Then, the dressing apparatus is provided with a cleaning liquid supply means. The cleaning liquid supply means supplies cleaning liquid to the cleaning liquid supply pipe while pressurizing the cleaning liquid. The cleaning liquid pressurized by the cleaning liquid supply means is discharged from the through-hole toward the polishing pad.

For example, JP-A-2002-187059 discloses a dressing mechanism for dressing the polishing pad of the polishing apparatus for semiconductor wafer. The dressing mechanism includes a dresser on which the diamond abrasive grains are electrodeposited. Further, the JP-A-2002-187059 discloses an injection nozzle. The injection nozzle injects the high-pressure water toward the polishing pad to clean a polishing surface.

For example, JP-A-2001-030169 discloses the dressing apparatus for dressing a polishing processing surface of a polishing table. A cleaning device provided in the dressing apparatus generates cavitation by discharging the high-pressure water into low-pressure water, and cleans the polishing surface by a shock wave generated by cavitation destructive force.

SUMMARY

A dressing apparatus includes a dresser provided in a polishing apparatus for polishing a board-like work by relative movement between the work and a polishing pad while bringing the polishing pad into contact with the work, the dresser having a dressing surface that slides relative to a polishing surface of the polishing pad to dress the polishing pad; a dresser drive member that rotates the dresser; a high-pressure water generating device that supplies high-pressure water pressurized to 1 to 15 MPa; and a high-pressure water injection nozzle that injects the high-pressure water toward the dressing surface rotating.

DETAILED DESCRIPTION

Figure 1:
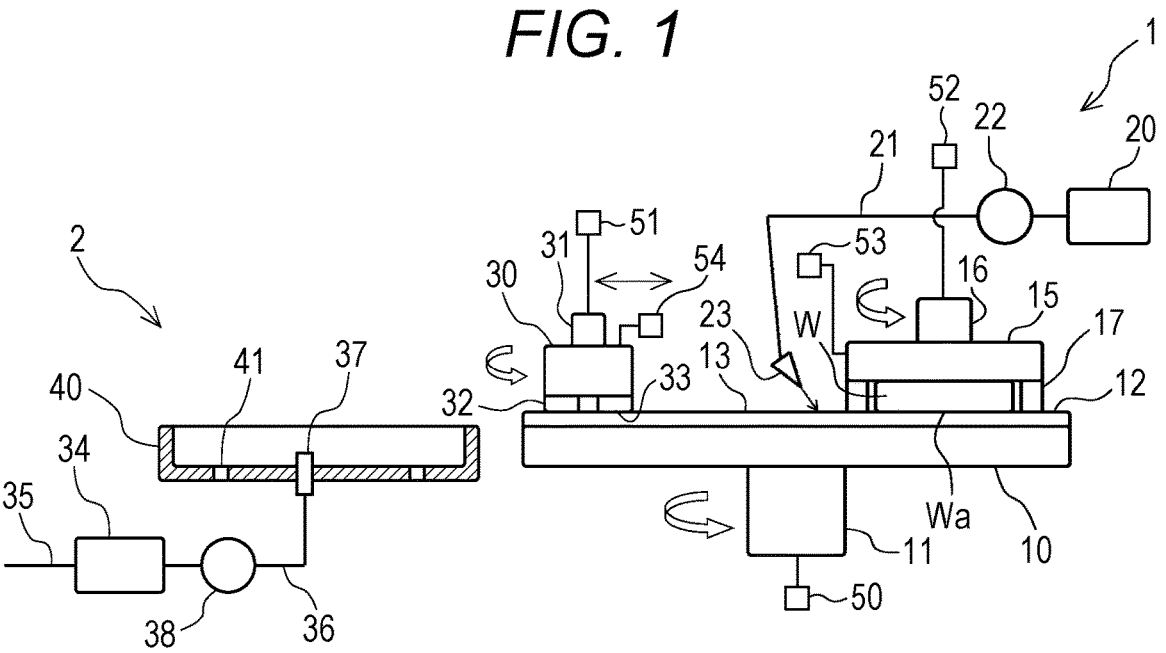
FIG. 1 is a front view illustrating a schematic configuration of a polishing apparatus according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, the dressing apparatus of the above-mentioned related art has a point to be improved in order to improve polishing performance of the polishing apparatus by enhancing a dressing effect.

Specifically, in a configuration in which the polishing surface is cleaned by injecting high-pressure water onto the polishing pad as in the polishing apparatus of the related art, although an effect of washing away polishing debris and the like from the polishing surface can be obtained, it is difficult to clean a dressing surface of the dressing apparatus.

That is, in the polishing apparatus of the related art, it is difficult to remove the polishing debris and the like containing metal and a polymer such as resin, the polishing debris and the like adhering to the dressing surface of the dresser by injecting the high-pressure water onto the polishing pad. Therefore, in the polishing apparatus of the related art, the polishing debris and the like adheres to the dressing surface, and dressing performance is reduced, and as a result, the polishing performance is reduced.

An object of the present disclosure is to provide the following dressing apparatus and polishing apparatus. That is, in these dressing apparatus and polishing apparatus, excellent dressing performance can be obtained and the polishing performance can be suitably maintained for a long period of time. Therefore, productivity of polishing can be increased.

A dressing apparatus (the present dressing apparatus) of one aspect of the present disclosure includes a dresser provided in a polishing apparatus for polishing a board-like work by relative movement between the work and a polishing pad while bringing the polishing pad into contact with the work, the dresser having a dressing surface that slides relative to a polishing surface of the polishing pad to dress the polishing pad; a dresser drive member that rotates the dresser; a high-pressure water generating device that supplies high-pressure water pressurized to 1 to 15 MPa; and a high-pressure water injection nozzle that injects the high-pressure water toward the dressing surface rotating.

In addition, a polishing apparatus of the present disclosure includes a polishing surface plate that holds a polishing pad so that a polishing surface of the polishing pad faces upward and rotates the polishing pad; a polishing head that holds a work so that a surface to be polished of a board-like work faces the polishing surface and rotationally presses the work; a diamond dresser having a dressing surface on which diamond abrasive grains are electrodeposited, the dressing surface sliding relative to the polishing surface to dress the polishing pad; a water tank provided at a position away from the polishing surface plate; a dresser drive member that rotates the diamond dresser; a dresser feed member that relatively moves the diamond dresser in a sliding direction and relatively moves the diamond dresser to above the water tank from above the polishing surface plate; a high-pressure water generating device that supplies high-pressure water pressurized to 1 to 15 MPa; and a high-pressure water injection nozzle that injects the high-pressure water toward the dressing surface rotating sent to above the water tank.

Furthermore, a polishing apparatus of the present disclosure includes a polishing surface plate that holds a work so that a surface to be polished of a board-like work faces upward and rotates the work; a polishing head that holds a polishing pad so that a polishing surface of the polishing pad faces the surface to be polished and rotationally presses the polishing pad; a water tank provided at a position away from the polishing surface plate; a diamond dresser provided above the water tank and having a dressing surface on which diamond abrasive grains are electrodeposited; a dresser drive member that rotates the diamond dresser; a polishing head feed member that relatively moves the polishing head from a polishing position above the polishing surface plate to a dressing position above the water tank, in which the polishing surface slides relative to the dressing surface and is dressed; a first high-pressure water generating device that supplies first high-pressure water pressurized to 1 to 15 MPa; a second high-pressure water generating device that supplies second high-pressure water pressurized to 1 to 15 MPa; a first high-pressure water injection nozzle that injects the first high-pressure water toward the dressing surface rotating above the water tank; and a second high-pressure water injection nozzle that is sent to above the water tank and injects the second high-pressure water toward the polishing surface rotating.

This dressing apparatus includes the high-pressure water generating device that supplies the high-pressure water pressurized to 1 to 15 MPa, and the high-pressure water injection nozzle that injects the high-pressure water toward the dressing surface of the rotating dresser. With such a configuration, the dressing surface of the dresser that dresses the polishing pad can be effectively cleaned.

Specifically, polishing pad residues and the like containing a polymer containing metal or the like and others, adhering to the dressing surface of the dresser due to dressing the polishing pad, can be removed by the high-pressure water while suppressing damage given to constituent materials of the dresser.

Thus, this dressing apparatus can maintain the excellent dressing performance for a long period of time. As a result, according to the polishing apparatus provided with this dressing apparatus, stable and excellent polishing characteristics can be obtained for a long period of time. Therefore, it is possible to suppress reduction of the polishing performance due to adhesion of the polishing debris and the like, thereby reducing time for polishing.

This dressing apparatus may further include a water tank provided at a position away from a polishing surface plate of the polishing apparatus, the polishing surface plate supporting the work or the polishing pad. Further, the high-pressure water injection nozzle may be provided to inject the high-pressure water onto the dressing surface, above the water tank. Thus, the polishing debris and the like containing metal, resin, and the like, which have been removed from the dressing surface, can be collected in the water tank and flushed out by injection of the high-pressure water. Therefore, it is possible to suppress readhesion of the removed polishing debris and the like to the work or the polishing pad.

This dressing apparatus may include a plurality of the dressers. Further, while the polishing pad is dressed by at least one of the dressers, by injecting the high-pressure water onto at least one of the other dressers, the at least one of the other dressers may be cleaned. Thus, dressing of the polishing pad and cleaning of the dresser can be performed at the same time. Therefore, it is possible to continuously perform a stable polishing for a long time.

For example, specifically, when polishing a thick film work and a work including a highly brittle material such as silicon carbide (SiC) and gallium nitride (GaN), the polishing is performed for a long period of time. In this regard, by using this dressing apparatus, even when polishing such a work, high-performance polishing can be continuously and stably performed. Therefore, according to this dressing apparatus, it is possible to reduce delay in polishing time due to the reduction of the polishing performance, thereby obtaining an excellent effect that production time can be reduced and the productivity can be increased.

This dressing apparatus may further include: a second high-pressure water generating device that supplies second high-pressure water pressurized to 1 to 15 MPa; and a second high-pressure water injection nozzle that injects the second high-pressure water toward the polishing surface of the polishing pad rotating. Thus, the dressing performance can be further improved by injecting the second high-pressure water onto the polishing surface of the polishing pad. Therefore, the polishing characteristics can be stably maintained.

In this dressing apparatus, the dresser may be a diamond dresser on which diamond abrasive grains are electrodeposited. This makes it possible, for example, to scrape out or roughen the polishing surface of the polishing pad. Thus, removal of clogging of the polishing pad and sharpening of the polishing pad can be suitably performed.

In this dressing apparatus, the dresser may be formed of a synthetic resin. Thus, the polishing surface of the polishing pad can be stabilized with high accuracy. Therefore, this configuration can contribute to stabilization of excellent polishing characteristics.

In addition, a polishing apparatus of the present disclosure includes a polishing surface plate that holds a polishing pad so that a polishing surface of the polishing pad faces upward and rotates the polishing pad; a polishing head that holds a work so that a surface to be polished of a board-like work faces the polishing surface and rotationally presses the work; a diamond dresser having a dressing surface on which diamond abrasive grains are electrodeposited, the dressing surface sliding relative to the polishing surface to dress the polishing pad; a water tank provided at a position away from the polishing surface plate; a dresser drive member that rotates the diamond dresser; a dresser feed member that relatively moves the diamond dresser in a sliding direction and relatively moves the diamond dresser to above the water tank from above the polishing surface plate; a high-pressure water generating device that supplies high-pressure water pressurized to 1 to 15 MPa; and a high-pressure water injection nozzle that injects the high-pressure water toward the dressing surface rotating sent to above the water tank.

In such a configuration, the dressing performance can be improved by injecting the high-pressure water onto the dressing surface of the diamond dresser. Therefore, highly efficient dressing can be performed by using a highly accurate diamond dresser with less polishing debris. Therefore, the performance of the polishing apparatus can be improved.

Furthermore, a polishing apparatus of the present disclosure includes a polishing surface plate that holds a work so that a surface to be polished of a board-like work faces upward and rotates the work; a polishing head that holds a polishing pad so that a polishing surface of the polishing pad faces the surface to be polished and rotationally presses the polishing pad; a water tank provided at a position away from the polishing surface plate; a diamond dresser provided above the water tank and having a dressing surface on which diamond abrasive grains are electrodeposited; a dresser drive member that rotates the diamond dresser; a polishing head feed member that relatively moves the polishing head from a polishing position above the polishing surface plate to a dressing position above the water tank, in which the polishing surface slides relative to the dressing surface and is dressed; a first high-pressure water generating device that supplies first high-pressure water pressurized to 1 to 15 MPa; a second high-pressure water generating device that supplies second high-pressure water pressurized to 1 to 15 MPa; a first high-pressure water injection nozzle that injects the first high-pressure water toward the dressing surface rotating above the water tank; and a second high-pressure water injection nozzle that is sent to above the water tank and injects the second high-pressure water toward the polishing surface rotating.

In such a configuration, while the dressing surface of the diamond dresser can be cleaned by injecting the first high-pressure water, the polishing surface of the polishing pad can be dressed by the diamond dresser. Further, by injecting the second high-pressure water, the polishing debris and the like on the polishing surface can be efficiently removed.

Utilizing both sliding of the diamond dresser cleaned with the first high-pressure water and injection of the second high-pressure water, the polishing pad of a small-diameter pad type polishing apparatus, for example, using the polishing pad having a diameter smaller than that of the work can be dressed with high efficiency.

That is, even for the small-diameter pad type polishing in which a small-diameter polishing pad is rotated at a high speed, it is possible to suppress reduction in polishing speed due to the clogging or the like of the polishing pad and perform high-speed and high-efficiency polishing.

Hereinafter, the dressing apparatus according to the embodiment of the present disclosure and the polishing apparatus provided with the dressing apparatus will be described in detail with reference to the drawings.

FIG. 1 is a front view illustrating a schematic configuration of a polishing apparatus 1 having a dressing apparatus 2 according to the present embodiment, and illustrates a state in which the polishing apparatus 1 is performing a polishing step.

Referring to FIG. 1, the polishing apparatus 1 is an apparatus that polishes a surface of a work W having a substantially board shape. The work W is, for example, a semiconductor substrate. The polishing apparatus 1 is an apparatus that performs, for example, chemical mechanical polishing (CMP) so as to finish a surface of a semiconductor or the like forming the work W or various coatings or the like formed on the surface of the semiconductor or the like substantially flat and with high accuracy.

The polishing apparatus 1 includes a polishing surface plate 10 for holding a polishing pad 12, a polishing head 15 for holding the work W, a polishing liquid supply device 20 for supplying a polishing liquid, and the dressing apparatus 2 used for dressing the polishing pad 12.

The polishing surface plate 10 is a device that adsorbs, holds, and rotates the polishing pad 12 for polishing the work W. A holding surface having a substantially circular shape and holding the polishing pad 12 is rotatably provided on an upper portion of the polishing surface plate 10. Specifically, a rotating shaft 11 extending in a vertical direction, that is, in a direction perpendicular to an upper surface of the polishing surface plate 10 is provided in a lower portion of the polishing surface plate 10. The polishing surface plate 10 is rotatable about the rotating shaft 11.

The polishing pad 12 is placed on the holding surface of the polishing surface plate 10. The polishing pad 12 may be vacuum-adsorbed to the holding surface of the polishing surface plate 10, for example, by using a decompression device or the like (not illustrated).

Specifically, a mounting table (not illustrated) may be provided on the holding surface of the polishing surface plate 10 for holding the polishing pad 12. As the mounting table, for example, a plate material containing porous aluminum oxide, porous ceramics, sintered metal, or other synthetic resin porous material may be used.

The polishing pad 12 is a pad material for polishing the work W. As a material of the polishing pad 12, for example, a foamed polyurethane sheet, a non-woven fabric made of synthetic fibers or the like, or other felts may be used.

The polishing apparatus 1 has a surface plate drive member 50 that rotates the polishing surface plate 10. The polishing pad 12 held on the upper surface of the polishing surface plate 10 is driven by the surface plate drive member 50 and rotates about the rotating shaft 11 together with the polishing surface plate 10. As described above, in the polishing apparatus 1, the polishing surface plate 10 holds the polishing pad 12 so that a polishing surface 13 of the polishing pad 12 faces upward, and rotates the polishing pad 12.

The polishing head 15 is a device that adsorbs, holds, and rotates the work W to be polished. Specifically, the polishing head 15 has a retainer 17 for holding a vicinity of a peripheral end portion of the work W, and the retainer 17 holds the work W. The polishing head 15 may have a chuck mechanism (not illustrated). The chuck mechanism of the polishing head 15 has a substantially circular holding surface (not illustrated) for holding the work W.

The polishing head 15 is provided with a rotating shaft 16 extending in the vertical direction, that is, in a direction perpendicular to the holding surface. The holding surface for holding the work W in the chuck mechanism of the polishing head 15 is configured to be rotatable about the rotating shaft 16. That is, the holding surface rotates by being driven by a polishing head drive member 52. Therefore, the work W rotates about the rotating shaft 16.

The polishing apparatus 1 has a polishing head feed member 53 that feeds the polishing head 15 in the vertical direction. Further, the polishing apparatus 1 has a pressing member (not illustrated) that presses the work W held by the polishing head 15 toward the polishing surface 13 of the polishing pad 12.

In the polishing apparatus 1, the work W is polished by bringing the polishing pad 12 into contact with the work W and moving the work W and the polishing pad 12 relative to each other. Specifically, in the polishing step, a surface Wa to be polished, that is, a lower surface of the work W is in contact with and pressed against the polishing surface 13 that is an upper surface of the polishing pad 12 rotating about the rotating shaft 11 while rotating about the rotating shaft 16. Thus, the surface Wa to be polished of the work W is polished. As described above, in the polishing apparatus 1, the polishing head 15 holds the work W so that the surface Wa to be polished of the work W faces the polishing surface 13 of the polishing pad 12, and rotationally presses the work W.

A diameter of the holding surface of the polishing head 15 for holding the work W is smaller than that of the holding surface of the polishing surface plate 10 for holding the polishing pad 12. In other words, a diameter of the work W is smaller than that of the polishing pad 12. Specifically, the diameter of the work W is half or less than that of the polishing pad 12. With such a configuration, the surface Wa to be polished of the work W can be polished with high accuracy by utilizing a wide range of the polishing surface 13 of the polishing pad 12.

The polishing liquid supply device 20 is a device that supplies the polishing liquid to the polishing pad 12 in the polishing step. A polishing liquid pipe 21 for flowing the polishing liquid is connected to the polishing liquid supply device 20. The polishing liquid pipe 21 is provided with a polishing liquid valve 22 for regulating flow of the polishing liquid.

Near a tip of the polishing liquid pipe 21, a polishing liquid injection nozzle 23 for injecting the polishing liquid toward the polishing surface 13 of the polishing pad 12 is provided. In the polishing step of polishing the work W, the polishing liquid supplied from the polishing liquid supply device 20 is injected from the polishing liquid injection nozzle 23 onto the polishing surface 13. Here, as the polishing liquid injected from the polishing liquid injection nozzle 23, for example, silicon oxide (silica), aluminum oxide (alumina), cerium oxide (ceria), manganese oxide, or the like as abrasive grains, which are turbid alone or in combination in an amount of 1 to 20 mass % in a solution such as pure water, an alkaline aqueous solution, or an acidic aqueous solution, is used.

The dressing apparatus 2 is an apparatus for dressing the polishing surface 13 of the polishing pad 12. The dressing apparatus 2 includes a dresser 30 for removing the clogging of the polishing pad 12 and sharpening the polishing pad 12, a high-pressure water generating device 34 for generating the high-pressure water, and a high-pressure water injection nozzle 37 for injecting the high-pressure water onto the dresser 30.

The dresser 30 has a substantially disk-like shape. A lower surface of the dresser 30 is a dressing surface 33 having a substantially annular shape that contacts the polishing surface 13 of the polishing pad 12. The dressing surface 33 is a surface that slides relative to the polishing surface 13 of the polishing pad 12 to dress the polishing pad 12.

Specifically, the dressing apparatus 2 has a dresser drive member 51 for rotating the dresser 30. The dresser 30 is provided with a rotating shaft 31 for transmitting power of the dresser drive member 51. That is, the dresser 30 is driven and rotated via the rotating shaft 31 by the dresser drive member 51.

The dressing apparatus 2 has a dresser feed member 54 that relatively moves the dresser 30 in the sliding direction in the dressing step. The dresser feed member 54 swings the dresser 30 by feeding the dresser 30 in the vertical direction and the horizontal direction. Thus, the dresser 30 is driven by the dresser drive member 51 to rotate, and is sent and swung by the dresser feed member 54, so that the wide range of the polishing surface 13 of the polishing pad 12 can be dressed.

The dresser 30 is, for example, the diamond dresser on which the diamond abrasive grains are electrodeposited. That is, a diamond layer 32 containing diamond abrasive grains is formed near the lower surface of the dresser 30. The diamond abrasive grains are held in the diamond layer 32 by nickel (Ni) electrodeposition. The diamond dresser may have the dressing surface 33 on which the diamond abrasive grains are electrodeposited.

As described above, by using the diamond dresser as the dresser 30, it is possible, for example, to scrape out or roughen the polishing surface 13 of the polishing pad 12. Thus, the removal of the clogging of the polishing pad 12 and the sharpening of the polishing pad 12 can be suitably performed.

The dresser 30 may be formed of, for example, a synthetic resin. A synthetic resin material constituting the dresser 30 is preferably an industrial plastic (engineering plastic) having high strength and excellent heat resistance, for example, polyamide (PA), polyetheretherketone (PEEK), or the like. Specifically, the dresser 30 may be a nylon brush, a PEEK brush, or the like.

As described above, by forming the dresser 30 from a synthetic resin having high strength and excellent heat resistance, it is possible to realize a highly accurate dressing that stabilizes the polishing surface 13 of the polishing pad 12. Note that the dresser 30 may be mainly formed from industrial plastic. Alternatively, the dresser 30 may hold the diamond abrasive grains electrodeposited by Ni electrodeposition as described above.

The high-pressure water generating device 34 is a device that supplies the high-pressure water for cleaning to the dresser 30. The high-pressure water generating device 34 is connected to a water pipe 35 for supplying pressurized water to the high-pressure water generating device 34 and to a high-pressure water pipe 36 for flowing the pressurized high-pressure water from the high-pressure water generating device 34 to the dresser 30.

The high-pressure water pipe 36 is provided with a high-pressure water valve 38 that regulates a flow rate of the high-pressure water. The high-pressure water injection nozzle 37 is provided near a downstream end of the high-pressure water pipe 36. The high-pressure water injection nozzle 37 injects the high-pressure water toward the dressing surface 33 of the dresser 30.

The dressing apparatus 2 has a water tank 40. The water tank 40 is a water receiving tank used in a dresser cleaning step of cleaning the dresser 30 with the high-pressure water. The water tank 40 is provided at a position away from the polishing surface plate 10 that supports the polishing pad 12. In the vicinity of a bottom surface of the water tank 40, a drain port 41 for discharging the water dropped and received from the dressing surface 33 to an outside of the water tank 40 is formed.

Figure 2:
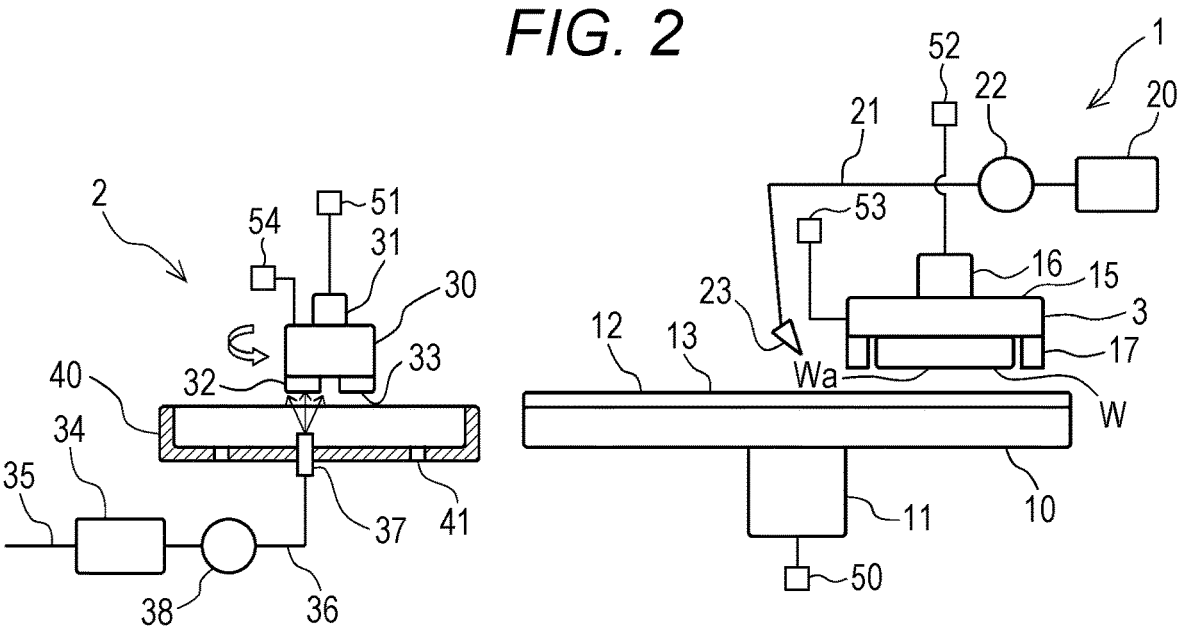
FIG. 2 is a front view illustrating the schematic configuration of the polishing apparatus according to the embodiment of the present disclosure.

FIG. 2 is a front view illustrating a schematic configuration of the polishing apparatus 1, and illustrates a state of performing the dresser cleaning step in the polishing apparatus 1.

As illustrated in FIG. 2, in the dresser cleaning step of cleaning the dresser 30 with the high-pressure water, the dresser 30 moves to above the water tank 40.

Specifically, in the dressing step, the above-mentioned dresser feed member 54, which relatively moves the dresser 30 in the sliding direction, reciprocates (relatively moves) the dresser 30 from above the polishing surface plate 10 to above the water tank 40. That is, the dresser 30 is sent in the vertical direction and the horizontal direction by the dresser feed member 54. Thus, the dresser 30 is sent to the upper surface of the polishing pad 12 in the dressing step, as illustrated in FIG. 1. On the other hand, in the dresser cleaning step, the dresser 30 is sent to above the water tank 40, as illustrated in FIG. 2.

In the dresser cleaning step, the polishing step of polishing the work W may be stopped. When the polishing step is stopped, the polishing head 15 is fed upward by the polishing head feed member 53, as illustrated in FIG. 2. Thus, the surface Wa to be polished of the work W is separated from the polishing surface 13 of the polishing pad 12. Further, rotation of the polishing surface plate 10 and the polishing head 15 is stopped.

Although not illustrated, contrary to the above, in the dresser cleaning step, the polishing step of polishing the work W may be performed at the same time as the dresser cleaning step. In this case, the surface Wa to be polished of the work W contacts and is pressed against the polishing surface 13 of the polishing pad 12, and is polished while sliding relative to the polishing surface 13.

As illustrated in FIG. 2, the dresser 30 sent to above the water tank 40 for the dresser cleaning step is driven and rotated by the dresser drive member 51. Then, the high-pressure water is injected from the high-pressure water injection nozzle 37 onto the dressing surface 33 of the dresser 30 that is sent to above the water tank 40 and is rotating.

That is, the high-pressure water pressurized by the high-pressure water generating device 34 is injected from the high-pressure water injection nozzle 37 toward the dressing surface 33 via the high-pressure water pipe 36 and the high-pressure water valve 38. The high-pressure water injected from the high-pressure water injection nozzle 37 onto the dressing surface 33 is, for example, pure water. Note that as a liquid for the high-pressure water, for example, an alkaline aqueous solution or an acidic aqueous solution may be used.

The polishing pad residues and the like containing the polymer containing metal or the like and others, that are adhered to the dressing surface 33 of the dresser 30 by dressing the polishing pad 12, can be removed from the dressing surface 33 by collision of the high-pressure water due to injection of the high-pressure water onto the dressing surface 33. Further, in the dresser cleaning step, the polishing debris and the like are removed by injecting the high-pressure water, so that there is little damage to the constituent materials of the dresser 30. Therefore, the dressing surface 33 of the dresser 30 that dresses the polishing pad 12 can be effectively cleaned.

The high-pressure water is injected onto the dresser 30 above the water tank 40. Therefore, the polishing debris and the like containing metal, resin, and the like, which have been removed from the dressing surface 33, can be collected in the water tank 40 and flushed out, by the injection of the high-pressure water. Therefore, it is possible to suppress readhesion of the removed polishing debris and the like to the work W or the polishing pad 12.

It should be noted that, in order to suppress scattering of the polishing debris and the like from the dresser 30 to which the high-pressure water has been injected toward the polishing pad 12, a shatterproof plate or the like (not illustrated) to prevent the scattering of the polishing debris and the like may be provided between the water tank 40 and the polishing surface plate 10. Further, a scattering suppression lid or the like for suppressing the scattering of the polishing debris or the like may be provided above the water tank 40 so as to cover an upper opening of the water tank 40 near a periphery of the dresser 30.

Here, the high-pressure water injected onto the dresser 30 is pressurized to 1 to 15 MPa, preferably 3 to 15 MPa, and more preferably 5 to 12 MPa by the high-pressure water generating device 34. If a pressure of the high-pressure water is low, it is difficult to suitably remove the polishing debris and the like adhering to the dressing surface 33. On the contrary, if the pressure of the high-pressure water is too high, the damage given to the dressing surface 33 is too large. That is, there is a possibility that the dressing surface 33 is unnecessarily damaged and the dressing performance is reduced. Further, if the pressure is too high, there are also disadvantages from viewpoints of pressure resistance, power consumption, and the like.

A distance from the high-pressure water injection nozzle 37 to the dressing surface 33 is 20 to 60 mm, and preferably 30 to 50 mm. Further, the high-pressure water injected from the high-pressure water injection nozzle 37 spreads and collides with the dressing surface 33 in a substantially circular shape, and its diameter is 30 to 100 mm, and preferably 50 to 60 mm. By injecting the high-pressure water in this way, the dressing surface 33 can be suitably cleaned.

As described above, the polishing apparatus 1 cleans the dresser 30 by injecting the high-pressure water onto the dressing surface 33 of the dresser 30. Therefore, the highly efficient dressing can be performed by using the dresser 30 with less adhering polishing debris and the like. Therefore, the performance of the polishing apparatus 1 can be improved.

By cleaning the dresser 30 with high-pressure water, the dressing apparatus 2 can maintain the excellent dressing performance for a long period of time. As a result, according to the polishing apparatus 1, the stable and excellent polishing characteristics can be obtained for a long period of time. Therefore, it is possible to suppress the reduction of the polishing performance of the polishing pad 12 due to the adhesion of the polishing debris and the like, thereby reducing the time for polishing.

Next, with reference to FIGS. 3 to 5, polishing apparatuses 101 and 201 as modifications of the embodiment will be described in detail. The same components as those already described, or the components having the same operation and effect, are denoted by the same reference numerals, and descriptions thereof will be omitted.

Figure 3:
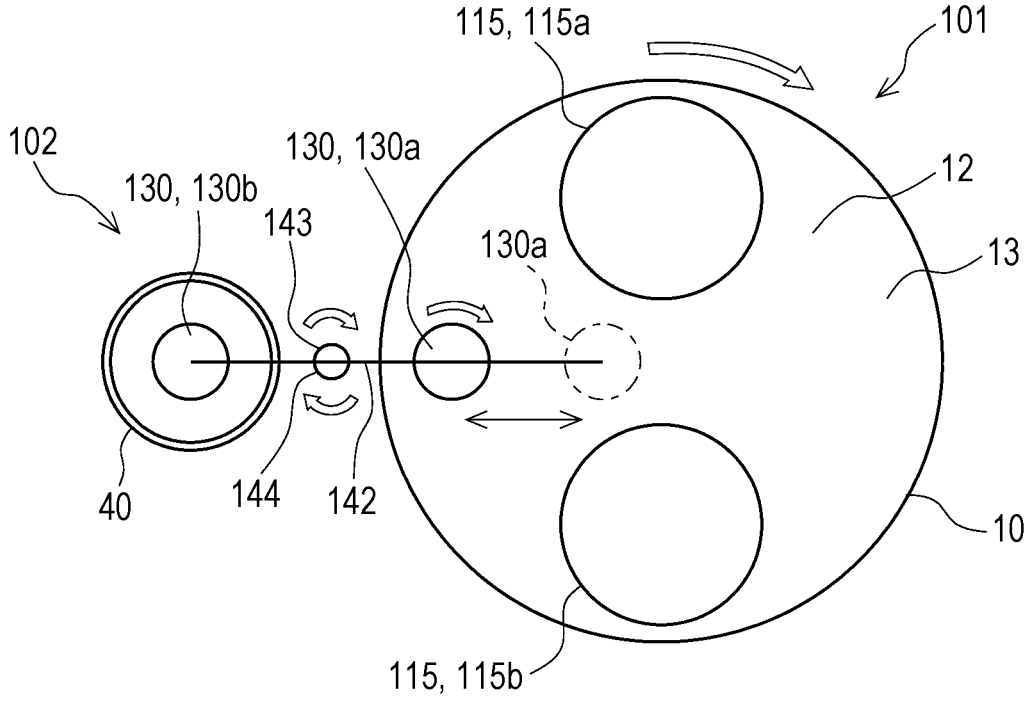
FIG. 3 is a plan view illustrating the schematic configuration of the polishing apparatus according to another embodiment of the present disclosure.

FIG. 3 is a plan view illustrating a schematic configuration of the polishing apparatus 101 according to another embodiment of the present disclosure.

As illustrated in FIG. 3, the polishing apparatus 101 has a plurality of polishing heads 115 and a plurality of dressers 130.

The polishing head 115 has substantially the same configuration as the polishing head 15 (see FIG. 1) described above, and rotates while holding the work W. The polishing apparatus 101 includes two polishing heads 115, that is, a polishing head 115*a* and a polishing head 115*b*.

Since the polishing apparatus 101 is provided with the two polishing heads 115*a* and 115*b*, two works W can be polished at the same time. Therefore, the polishing apparatus 101 is excellent in productivity. Note that the polishing apparatus 101 may be provided with two or more polishing heads 115.

The dressing apparatus 102 of the polishing apparatus 101 includes the plurality of dressers 130. The dresser 130 has substantially the same configuration as the dresser 30 (see FIG. 1) described above, and dresses the polishing surface 13 of the polishing pad 12.

Specifically, the polishing apparatus 101 includes two dressers 130, that is, a dresser 130*a* and a dresser 130*b*. Note that the polishing apparatus 101 may be configured to have two or more dressers 130.

The two dressers 130*a* and 130*b* are movably supported by a dresser arm 142. Specifically, the dressers 130 are swingable in the horizontal direction and are rotatable about an arm shaft 144.

That is, the dresser arm 142 has a horizontal expansion/contraction mechanism and supports the dressers 130 so as to be swingable. In the dressing step, the dresser 130 swings horizontally along the polishing surface 13, and the dressing surface 33 (see FIG. 1) of the dresser 130 contacts the polishing surface 13 and slides. Thus, the wide range of the polishing surface 13 can be dressed.

Then, the dresser arm 142 is rotatably supported about the arm shaft 144 by a dresser arm rotating mechanism 143. Therefore, the dressers 130 can be moved by rotating about the arm shaft 144.

As described above, the dressing apparatus 102 has the two dressers 130, and the two dressers 130 can rotate and move about the arm shaft 144. Thus, one dresser 130*a* can be disposed above the polishing surface plate 10, and the other dresser 130*b* can be disposed above the water tank 40.

Therefore, when the polishing pad 12 is dressed by the one dresser 130*a*, the other dresser 130*b* can be cleaned by injecting the high-pressure water from the high-pressure water injection nozzle 37 (see FIG. 2) onto the other dresser 130*b*.

In this way, the dressing apparatus 102 can simultaneously perform the dressing step (polishing step) of dressing the polishing pad 12 and the dresser cleaning step of cleaning the dresser 130. That is, it is not necessary to interrupt the dressing of the polishing pad 12 in order to clean the dresser 130. Therefore, according to the polishing apparatus 101, the stable polishing can be continuously performed for a long time by alternately using the two dressers 130.

For example, in general, when polishing a thick-film semiconductor wafer, a substrate containing a highly brittle material such as SiC and GaN, and the like, the polishing is performed for a long period of time. In the polishing apparatus 101, even when the above-mentioned substrate or the like is polished as the work W, the high-performance polishing can be continuously and stably performed. Therefore, according to the polishing apparatus 101, it is possible to reduce the delay in the polishing time due to the reduction of the polishing performance, thereby reducing the production time and increasing the productivity.

Figure 4:
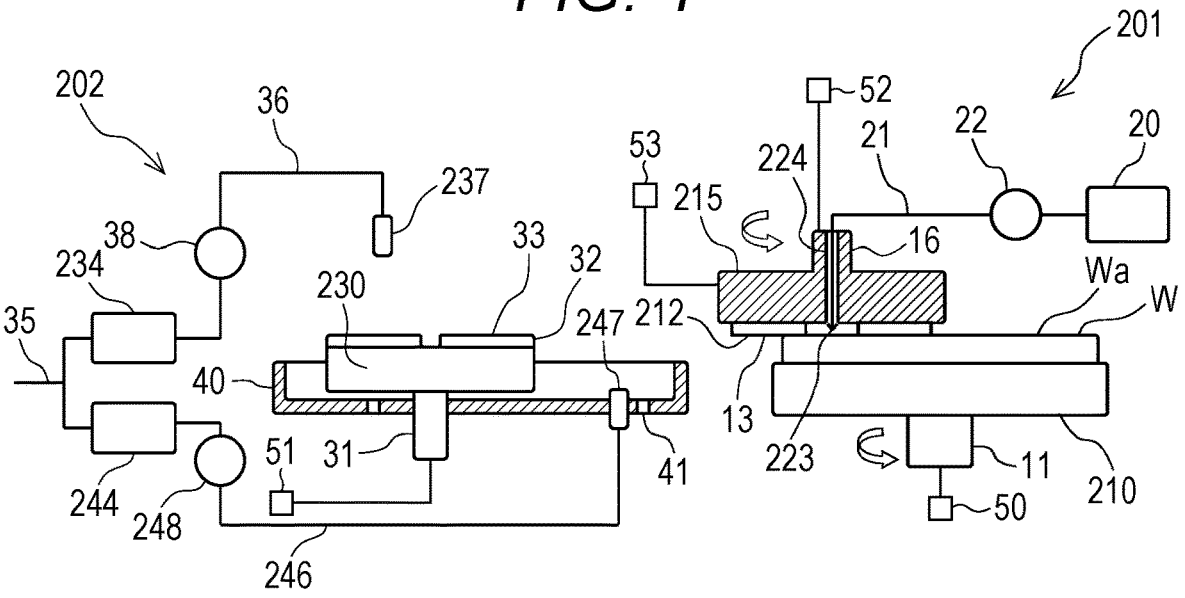
FIG. 4 is a front view illustrating the schematic configuration of the polishing apparatus according to another embodiment of the present disclosure.

FIG. 4 is a front view illustrating a schematic configuration of the polishing apparatus 201 according to still another embodiment of the present disclosure, and illustrates a state in which the polishing apparatus 201 is performing the polishing step.

As illustrated in FIG. 4, the polishing apparatus 201 is the small-diameter pad type apparatus, and a polishing pad 212 having a diameter smaller than that of the work W is used to polish the surface of the work W.

The polishing apparatus 201 includes a polishing surface plate 210 for holding the work W, a polishing head 215 for holding the polishing pad 212, the polishing liquid supply device 20 for supplying the polishing liquid, and a dressing apparatus 202 used for dressing the polishing pad 212.

The polishing surface plate 210 is a device that holds the work W so that the surface Wa to be polished of the work W faces upward and rotates the work W. The polishing surface plate 210 has the chuck mechanism (not illustrated) that adsorbs and holds the work W to be polished. The substantially circular holding surface to adsorb and hold the work W is formed on the upper portion of the polishing surface plate 210. A mounting table (not illustrated) may be provided on the holding surface of the polishing surface plate 210. As the mounting table, for example, the plate material containing porous aluminum oxide, porous ceramics, sintered metal, or other synthetic resin porous material may be used.

The rotating shaft 11 extending in the vertical direction, that is, in the direction perpendicular to the holding surface is provided in the lower portion of the polishing surface plate 210. The holding surface of the polishing surface plate 210 for holding the work W is configured to be rotatable about the rotating shaft 11. The work W held by the polishing surface plate 210 is driven by the surface plate drive member 50 and rotates about the rotating shaft 11.

The polishing head 215 is a device that adsorbs and holds the polishing pad 212 so that the polishing surface 13 faces the surface Wa to be polished, and rotates (rotates and presses) the polishing pad 212. A holding surface for holding the polishing pad 212 is provided in a lower portion of the polishing head 215. The holding surface of the polishing head 215 has a substantially circular shape and is rotatably provided.

The polishing pad 212 is a pad material for polishing the work W, and is formed in a substantially annular shape. As the material of the polishing pad 212, for example, a foamed polyurethane sheet, a non-woven fabric containing synthetic fibers, or other felts may be used.

The rotating shaft 16 extending in the vertical direction, that is, in the direction perpendicular to the holding surface, is provided on an upper portion of the polishing head 215. The polishing head 215 is rotatable about the rotating shaft 16. The polishing apparatus 201 has the polishing head drive member 52 that rotationally drives the polishing head 215. The polishing pad 212 is rotated by driving the polishing head 215 by the polishing head drive member 52.

The polishing apparatus 201 has the polishing head feed member 53 that feeds the polishing head 215 in the vertical direction. Further, the polishing apparatus 201 has the pressing member (not illustrated) that presses the polishing surface 13 of the polishing pad 212 held by the polishing head 215 toward the work W.

The polishing head feed member 53 can feed the polishing head 215 in the horizontal direction. That is, the polishing head 215 is swingable in the horizontal direction by being fed by the polishing head feed member 53.

Then, in the polishing apparatus 201, the work W is polished by bringing the polishing pad 212 into contact with the work W and relatively moving the work W and the polishing pad 212. Specifically, in the polishing step, the polishing surface 13 which is a lower surface of the polishing pad 212 is in contact with and pressed against the surface Wa to be polished, that is, an upper surface of the work W rotating about the rotating shaft 11 while rotating about the rotating shaft 16. Further, since the polishing head 215 is fed and swung by the polishing head feed member 53, the polishing pad 212 moves so that the polishing surface 13 comes into contact with an entire area of the surface Wa to be polished of the work W. Thus, the entire area of the surface Wa to be polished of the work W is polished.

The diameter of the holding surface of the polishing head 215 for holding the polishing pad 212 is smaller than that of the holding surface of the polishing surface plate 210 for holding the work W. In other words, a diameter of the polishing pad 212 is smaller than that of the work W. Specifically, the diameter of the polishing pad 212 is 70 to 80% of the diameter of the work W. With such a configuration, a large work W can be polished.

The polishing liquid supply device 20 is the device that supplies the polishing liquid to the polishing pad 212 in the polishing step. The polishing liquid pipe 21 for flowing the polishing liquid is connected to the polishing liquid supply device 20. The polishing liquid pipe 21 is provided with the polishing liquid valve 22 for regulating the flow of the polishing liquid.

A through-hole 224 that is a flow path for the polishing liquid is drilled near a center of the polishing head 215. A vicinity of the tip of the polishing liquid pipe 21 is connected to the through-hole 224. A lower portion of the through-hole 224 opens in a central space of the polishing pad 212 having a substantially annular shape. Then, a polishing liquid injection nozzle 223 for injecting the polishing liquid is formed near a lower opening of the through-hole 224.

In the polishing step of polishing the work W, the polishing liquid supplied from the polishing liquid supply device 20 is injected from an upper portion of the central space of the polishing pad 212 toward the work W below via the polishing liquid injection nozzle 223. Thus, the polishing liquid is suitably supplied from substantially a center of the polishing pad 212 to the surrounding polishing surface 13. As a result, good polishing characteristics can be obtained.

The dressing apparatus 202 is an apparatus for dressing the polishing surface 13 of the polishing pad 212. The dressing apparatus 202 includes a dresser 230 for removing the clogging of the polishing pad 212 and sharpening the polishing pad 212, a high-pressure water generating device 234 as a first high-pressure water generating device for supplying the first high-pressure water, and a high-pressure water injection nozzle 237 as a first high-pressure water injection nozzle for injecting the first high-pressure water. Further, the dressing apparatus 202 includes a high-pressure water generating device 244 as a second high-pressure water generating device for supplying the second high-pressure water, and a high-pressure water injection nozzle 247 as a second high-pressure water injection nozzle for injecting the second high-pressure water.

The dresser 230 dresses the polishing pad 212. The dresser 230 is, for example, the diamond dresser, and has substantially the same configuration as the dresser 30 (see FIG. 1) described above. The dresser 230 has a substantially disk-like shape. The dresser 230 is provided above the water tank 40 located away from the polishing surface plate 10 so that the dressing surface 33 faces upward. The dressing surface 33 slides relative to the polishing surface 13 of the polishing pad 212 to dress the polishing surface 13. For example, the diamond abrasive grains are electrodeposited on the dressing surface 33.

The dressing apparatus 202 has the dresser drive member 51 that rotates the dresser 230. The dresser 230 is rotated about the rotating shaft 31 by the power of the dresser drive member 51.

The high-pressure water generating device 234 is a first high-pressure water generating device that supplies the first high-pressure water. The high-pressure water generating device 234 is a device equivalent to the high-pressure water generating device 34 (see FIG. 1) described above. The first high-pressure water is the high-pressure water for cleaning the dresser 230.

The high-pressure water generating device 234 generates the high-pressure water by pressurizing the water supplied from the water pipe 35, and feeds the high-pressure water to the high-pressure water pipe 36. The high-pressure water pipe 36 is provided with the high-pressure water valve 38 that regulates the flow rate of the high-pressure water. The high-pressure water injection nozzle 237 is provided near the downstream end of the high-pressure water pipe 36.

The high-pressure water injection nozzle 237 is provided to inject the high-pressure water from above to the below the water tank 40. Specifically, the high-pressure water injection nozzle 237 opens toward the dressing surface 33 of the dresser 230. The high-pressure water injection nozzle 237 injects the high-pressure water pressurized by the high-pressure water generating device 234 toward the dressing surface 33 rotating above the water tank 40.

The high-pressure water generating device 244 is a second high-pressure water generating device that supplies the second high-pressure water. The second high-pressure water is the high-pressure water for cleaning the polishing surface 13 of the polishing pad 212.

The high-pressure water generating device 244 is connected to the water pipe 35 for supplying the pressurized water to the high-pressure water generating device 244 and to the high-pressure water pipe 246 for flowing the pressurized high-pressure water from the high-pressure water generating device 244 to the polishing pad 212.

The high-pressure water pipe 246 is provided with a high-pressure water valve 248 that regulates the flow rate of the high-pressure water. The high-pressure water injection nozzle 247 is provided near the downstream end of the high-pressure water pipe 246. In the dressing step, the high-pressure water injection nozzle 247 injects the high-pressure water toward the polishing surface 13 of the rotating polishing pad 212 that is sent above the water tank 40 and rotating. That is, the high-pressure water injection nozzle 247 is provided to inject the high-pressure water from below inside the water tank 40 toward above the water tank 40.

Figure 5:
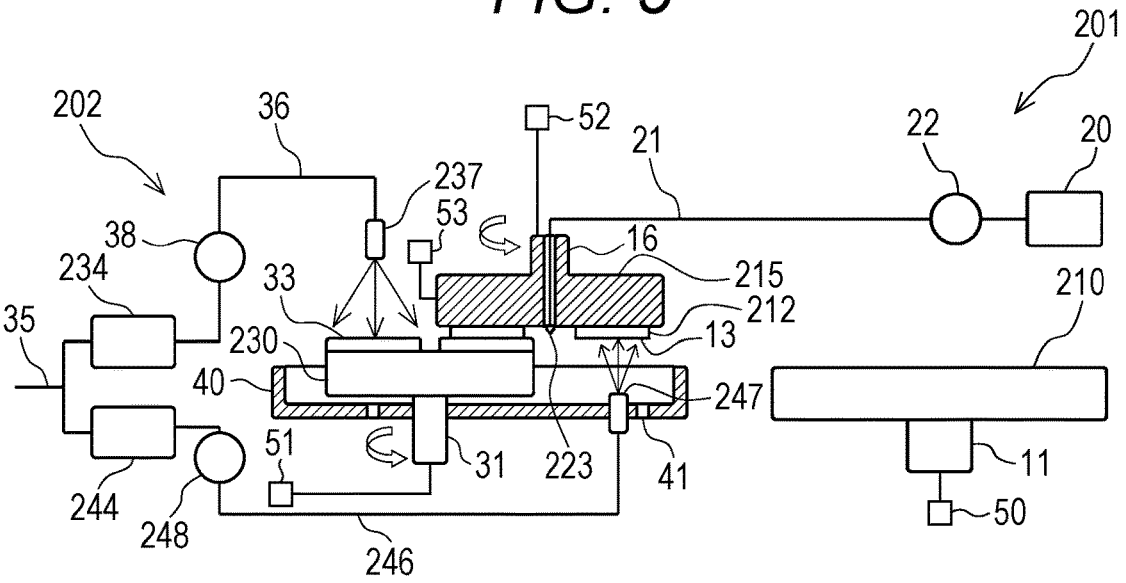
FIG. 5 is a front view illustrating the schematic configuration of the polishing apparatus according to another embodiment of the present disclosure.

FIG. 5 is a front view illustrating a schematic configuration of the polishing apparatus 201, and illustrates a state of performing the dressing step of the polishing apparatus 201.

Referring to FIG. 5, in the dressing step of dressing the polishing pad 212, the polishing head 215 is fed by the polishing head feed member 53, and moves from the polishing position above the polishing surface plate 210, to the dressing position above the water tank 40 of the dressing apparatus 202. The dressing position is a position above the water tank 40, in which the polishing surface 13 of the polishing pad 212 contacts the dressing surface 33 of the dresser 230. That is, at the dressing position, the polishing surface 13 slides relative to the dressing surface 33 and is dressed.

At the dressing position, the polishing head 215 is driven by the polishing head drive member 52 and rotates about the rotating shaft 16. The dresser 230 is driven by the dresser drive member 51 and rotates about the rotating shaft 31. Thus, the polishing surface 13 of the polishing pad 212 slides relative to the dressing surface 33 of the dresser 230, and the polishing surface 13 is dressed.

The high-pressure water injection nozzle 237 injects the high-pressure water pressurized by the high-pressure water generating device 234 toward the dressing surface 33 of the dresser 230 rotating above the water tank 40. Specifically, the high-pressure water is injected from above onto the dressing surface 33 located away from the polishing surface 13. Then, the dressing surface 33 is cleaned with the injected high-pressure water.

The pressure of the high-pressure water injected from the high-pressure water injection nozzle 237 to the dresser 230 is 1 to 15 MPa, preferably 3 to 15 MPa, and more preferably 5 to 12 MPa so that suitable cleaning performance can be obtained.

The high-pressure water injection nozzle 247 injects the high-pressure water pressurized by the high-pressure water generating device 244 toward the polishing surface 13 of the polishing head 215, which is rotating above the water tank 40. Specifically, the high-pressure water is injected from below onto the polishing surface 13 located away from the dressing surface 33. Then, the polishing surface 13 is cleaned with the injected high-pressure water.

The pressure of the high-pressure water injected from the high-pressure water injection nozzle 247 to the polishing pad 212 is 1 to 15 MPa, preferably 3 to 15 MPa, and more preferably 5 to 12 MPa so that suitable dressing performance can be obtained.

In this way, according to the dressing apparatus 202, the polishing surface 13 of the polishing pad 212 can be dressed by the dresser 230 while the dressing surface 33 of the dresser 230 is cleaned by injecting the first high-pressure water. Further, by injecting the second high-pressure water, the polishing debris and the like on the polishing surface 13 can be efficiently removed.

That is, the dressing apparatus 202 can dress the polishing pad 212 with high efficiency by utilizing both relative sliding of the dressing surface 33 cleaned with the first high-pressure water and the injection of the second high-pressure water.

Therefore, according to the polishing apparatus 201 having the dressing apparatus 202, in the small-diameter pad type polishing in which the polishing pad 212 having a diameter smaller than that of the work W is rotated at a high speed, it is possible to suppress reduction in polishing speed due to the clogging or the like of the polishing pad 212 and perform high-speed and high-efficiency polishing.

The technique of the present disclosure is not limited to the above-described embodiments, and various modifications can be made without departing from the gist of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A dressing apparatus comprising:

a dresser provided in a polishing apparatus for polishing a work by relative movement between the work and a polishing pad while bringing the polishing pad into contact with the work, the dresser having a dressing surface that slides relative to a polishing surface of the polishing pad to dress the polishing pad;

a dresser drive member that rotates the dresser;

a first high-pressure water generating device that supplies first high-pressure water pressurized to 1 to 15 MPa;

a second high-pressure water generating device that supplies second high-pressure water pressurized to 1 to 15 MPa;

a first high-pressure water injection nozzle that injects the first high-pressure water toward the dressing surface rotating; and a second high-pressure water injection nozzle that injects the second high-pressure water toward the polishing surface of the polishing pad rotating, wherein the dressing surface of the dresser faces upward;

the polishing surface of the polishing pad faces downward;

the first high-pressure water injection nozzle faces downward and injects the first-high pressure water downwardly toward the dressing surface; and a vertical axis of the rotating dresser and a vertical axis of the polishing pad are horizontally offset such that the second high-pressure water injection nozzle faces upward and injects the second-high-pressure water upwardly toward the polishing surface while the first high-pressure water injection nozzle injects the first-high pressure water downwardly toward the dressing surface.

2. The dressing apparatus according to claim 1, further comprising a water tank provided at a position of the polishing apparatus, the position away from a polishing surface plate that supports the work or the polishing pad, wherein the first high-pressure water injection nozzle is provided to inject the first high-pressure water onto the dressing surface, above the water tank.

3. The dressing apparatus according to claim 1, comprising a plurality of the dressers, wherein the at least one of the other dressers is cleaned by injecting the high-pressure water onto at least one of the other dressers while the polishing pad is dressed by at least one of the dressers.

4. The dressing apparatus according to claim 1, wherein the dresser is a diamond dresser on which diamond abrasive grains are electrodeposited.

5. The dressing apparatus according to claim 1, wherein the dresser is formed of a synthetic resin.

6. The dressing apparatus according to claim 1, wherein the dresser dresses the polishing surface while the first high-pressure water injection nozzle injects the first-high pressure water downwardly toward the dressing surface located away from the polishing surface and while the second high-pressure water injection nozzle injects the second-high-pressure water upwardly toward the polishing surface located away from the dressing surface.

7. A polishing apparatus comprising:

a polishing surface plate that holds a work so that a surface to be polished of a work faces upward and rotates the work;

a polishing head that holds a polishing pad so that a polishing surface of the polishing pad faces the surface to be polished and rotationally presses the polishing pad;

a water tank provided at a position away from the polishing surface plate;

a diamond dresser provided above the water tank and having a dressing surface on which diamond abrasive grains are electrodeposited;

a dresser drive member that rotates the diamond dresser;

a polishing head feed member that relatively moves the polishing head from a polishing position above the polishing surface plate to a dressing position above the water tank, in which the polishing surface slides relative to the dressing surface and is dressed;

a first high-pressure water generating device that supplies first high-pressure water pressurized to 1 to 15 MPa;

a second high-pressure water generating device that supplies second high-pressure water pressurized to 1 to 15 MPa;

a first high-pressure water injection nozzle that injects the first high-pressure water toward the dressing surface rotating above the water tank; and a vertical axis of the rotating dresser and a vertical axis of the polishing pad are horizontally offset such that a second high-pressure water injection nozzle that is sent to above the water tank and injects the second high-pressure water toward the polishing surface rotating while the first high-pressure water injection nozzle injects the first-high pressure water toward the dressing surface rotating above the water tank.

8. The polishing apparatus according to claim 7, wherein the dressing surface of the dresser faces upward; the polishing surface of the polishing pad faces downward; the first high-pressure water injection nozzle faces downward and injects the first-high pressure water downwardly toward the dressing surface; and the second high-pressure water injection nozzle faces upward and injects the second-high-pressure water upwardly toward the polishing surface.

9. The polishing apparatus according to claim 7, wherein the diamond dresser dresses the polishing surface while the first high-pressure water injection nozzle injects the first-high pressure water toward the dressing surface rotating above the water tank and located away from the polishing surface and while the second high-pressure water injection nozzle injects the second-high-pressure water toward the polishing surface rotating and located away from the dressing surface.

* * * * *